US011920804B2

(12) United States Patent
Esso

(10) Patent No.: US 11,920,804 B2
(45) Date of Patent: Mar. 5, 2024

(54) EXPANDABLE ENVIRONMENTAL CONTROL UNIT

(71) Applicant: AAR MANUFACTURING, INC., Wood Dale, IL (US)

(72) Inventor: Derek P. Esso, Wood Dale, IL (US)

(73) Assignee: AAR MANUFACTURING, INC., Wood Dale, IL (US)

( * ) Notice: Subject to any disclaimer, the term of this patent is extended or adjusted under 35 U.S.C. 154(b) by 18 days.

(21) Appl. No.: 17/385,306

(22) Filed: Jul. 26, 2021

(65) Prior Publication Data

US 2023/0021790 A1 Jan. 26, 2023

(51) Int. Cl.

| | |
|---|---|
| ***F24F 1/04*** | (2011.01) |
| ***F24F 1/022*** | (2019.01) |
| ***F24F 13/30*** | (2006.01) |

(52) U.S. Cl.

CPC ..... *F24F 1/04* (2013.01); *F24F 1/022* (2013.01); *F24F 13/30* (2013.01); *F24F 2221/12* (2013.01)

(58) Field of Classification Search

CPC ..... F24F 1/04; F24F 1/022; F24F 2221/12
See application file for complete search history.

(56) References Cited

U.S. PATENT DOCUMENTS

| | | | | |
|---|---|---|---|---|
| 2,251,960 | A * | 8/1941 | Smith | F24F 1/022 62/262 |
| 2,994,211 | A * | 8/1961 | Lehmkuhl | F24F 1/04 62/262 |
| 3,740,964 | A * | 6/1973 | Herweg | F24F 1/32 62/448 |
| 3,777,506 | A * | 12/1973 | Hergatt | B60H 1/00264 62/262 |
| 3,802,216 | A * | 4/1974 | Brandimarte | F24F 1/022 62/262 |
| 5,685,165 | A * | 11/1997 | Bigelow, Jr. | F24F 5/0017 62/457.2 |
| 6,662,588 | B2 | 12/2003 | Houk et al. | |
| 7,481,869 | B2 * | 1/2009 | Vanderhoof | B01D 53/268 95/52 |
| 11,486,602 | B2 * | 11/2022 | Kumra | F24F 5/0035 |
| 2010/0227542 | A1 * | 9/2010 | Goldmann | F24F 1/022 454/258 |
| 2011/0277495 | A1 | 11/2011 | Lee et al. | |
| 2012/0060956 | A1 | 3/2012 | Zwiernik et al. | |
| 2018/0356124 | A1 | 12/2018 | Gupte et al. | |
| 2019/0360719 | A1 | 11/2019 | Garg et al. | |
| 2021/0396425 | A1 * | 12/2021 | Davtyan | F24F 1/032 |

FOREIGN PATENT DOCUMENTS

| | | |
|---|---|---|
| CN | 1740658 | 3/2006 |
| CN | 206771555 | 12/2017 |
| DE | 202008002972 U1 | 7/2008 |
| EP | 3076089 | 10/2016 |

OTHER PUBLICATIONS

Extended European Search Report issued in Appl. No. EP22186646.0 (dated Dec. 5, 2022).

* cited by examiner

*Primary Examiner* — Christopher R Zerphey
(74) *Attorney, Agent, or Firm* — Barnes & Thornburg LLP

(57) ABSTRACT

An environmental control unit for providing heated or cooled air to an enclosed environment, such as a building structure or temporary shelter. Air passes through the environmental control unit and the air is heated or cooled by a temperature control system of the environmental control unit. The heated or cooled air is provided to the enclosed environment.

15 Claims, 15 Drawing Sheets

EXPANDABLE ENVIRONMENTAL CONTROL UNIT

FIELD OF THE DISCLOSURE

The present disclosure relates generally to an environmental control unit, and specifically to a portable environmental control unit. More specifically, the present disclosure relates to a portable environmental control unit for cooling and/or heating an enclosed space, such as a building structure or temporary shelter.

BACKGROUND

Temporary shelters, such as field hospitals and living quarters, often require cooling and/or heating to maintain a comfortable space to work, eat, and sleep. Portable environmental control units can be shipped with the temporary shelters or otherwise transported to a location in the field to provide cooling and/or heating to these structures. Size and weight restrictions can be imposed on environmental control units to minimize the cost and burden of transporting the units to the field. However, these restrictions limit the capacity and/or efficiency of the environmental control units. It would be desirable to have a portable environmental control unit with improved capacity and/or efficiency with minimal footprint for transport.

This background information is merely for context and no admission is intended, nor should such admission be inferred or construed, that any of the preceding information constitutes prior art against the present disclosure.

The exemplification set out herein illustrates embodiments of the disclosure that are not to be construed as limiting the scope of the disclosure in any manner. Additional features of the present disclosure will become apparent to those skilled in the art upon consideration of the following detailed description of illustrative embodiments exemplifying modes of carrying out the disclosure as presently perceived.

DETAILED DESCRIPTION

Figure 2:
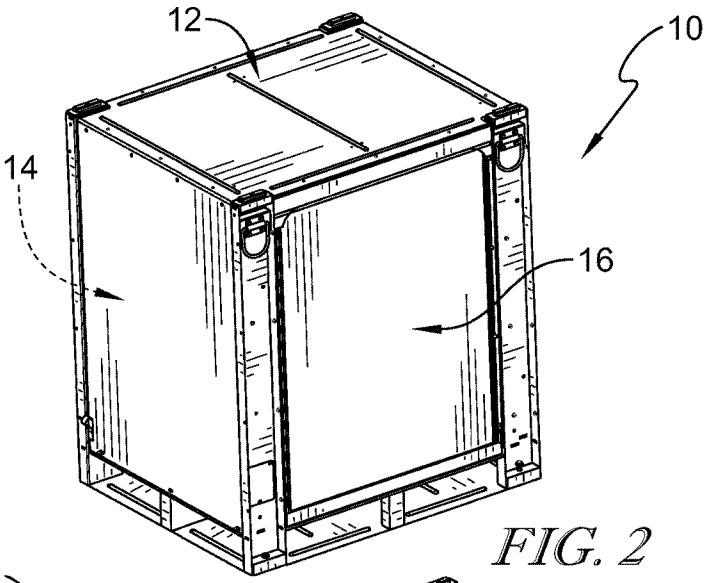
FIG. 2 is a rear perspective view of the ECU of FIG. 1.
Figure 1:
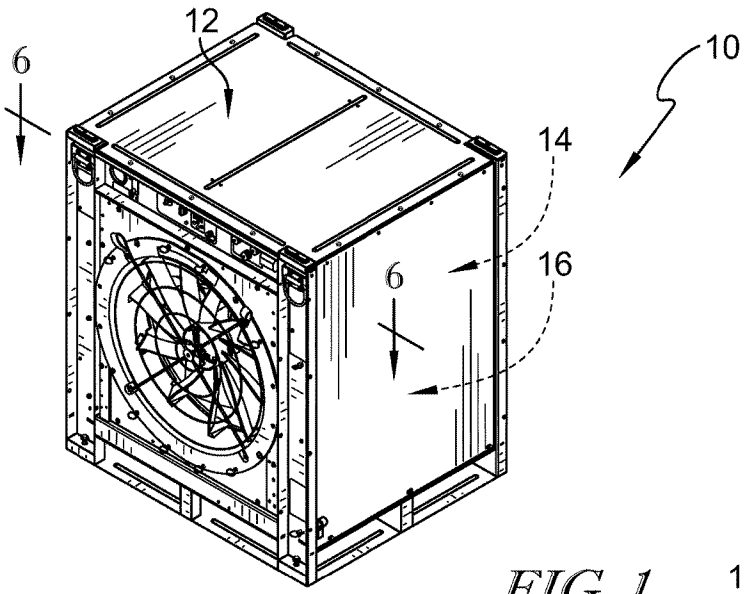
FIG. 1 is a front perspective view of an expandable environmental control unit (ECU) showing that the ECU includes a base section, a mobile section coupled to the base section, and a temperature control system coupled to the base section and the mobile section, and suggesting that the mobile section is arranged for movement between a collapsed-storage position, shown in FIGS. 1 and 2, and an expanded-use position, shown in FIGS. 3 and 4.
Figure 4:
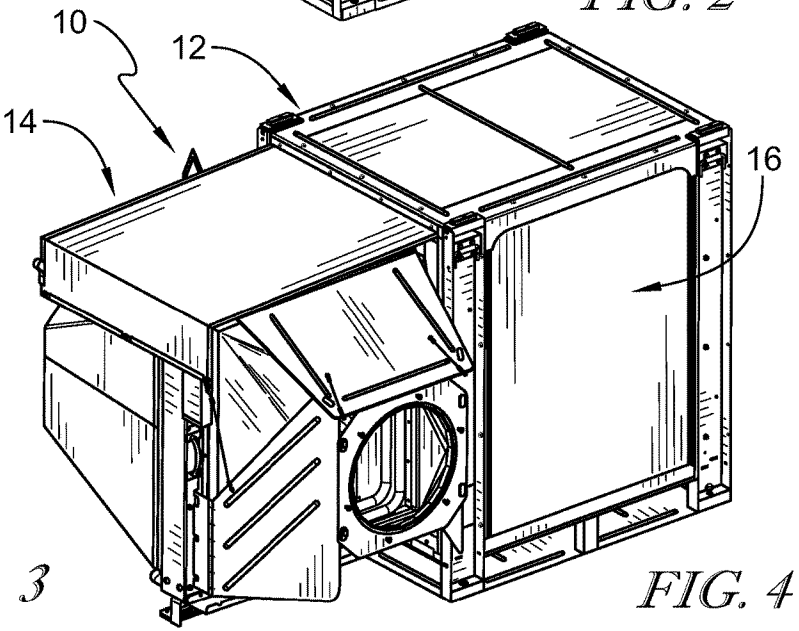
FIG. 4 is a rear perspective view of the ECU of FIG. 3.
Figure 3:
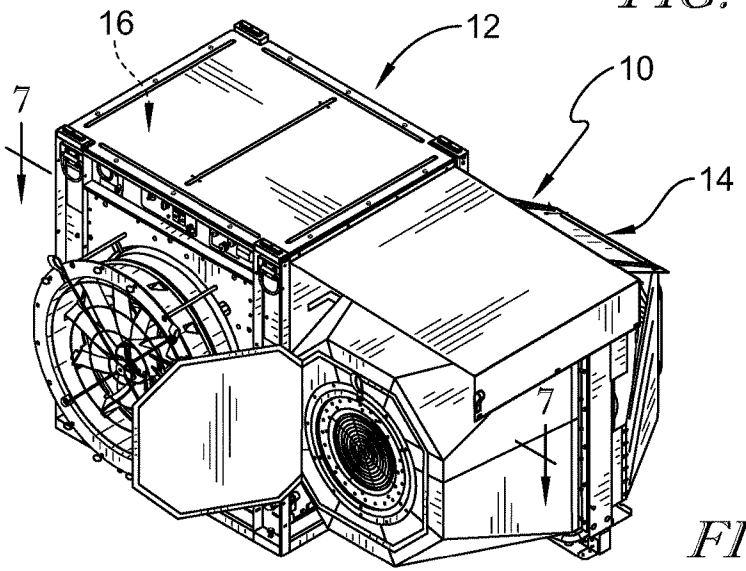
FIG. 3 is a view similar to FIG. 1 showing the ECU in the expanded-use position with the mobile section extending from the base section.
Figure 6:
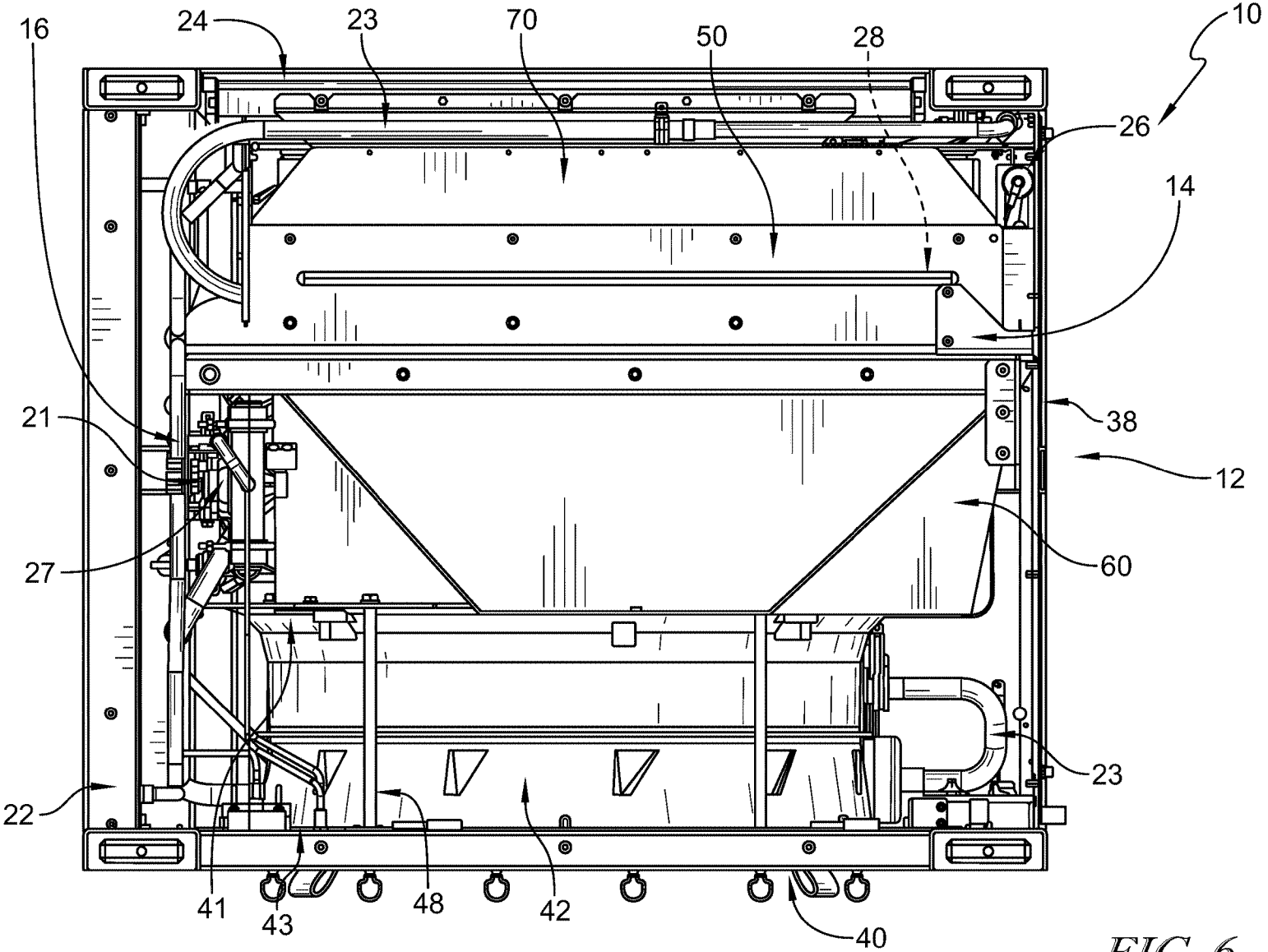
FIG. 6 is a section view taken along line 6-6 in FIG. 1 showing the mobile section arranged within the base section in the collapsed-storage position.

An illustrative expandable environmental control unit (ECU) 10 in accordance with the present disclosure is shown in FIGS. 1-4. The ECU 10 includes a base section 12, a mobile section 14 coupled to the base section 12, and a temperature control system 16 coupled to the base section 12 and the mobile section 14. The mobile section 14 is arranged for movement relative to the base section 12 between a collapsed-storage position, shown in FIGS. 1 and 2, and an expanded-use position, shown in FIGS. 3 and 4. The ECU 10 is arranged within a first footprint in the collapsed-storage position and is arranged in a larger second footprint in the expanded-use position. The mobile section 14 and temperature control system 16 are contained within the base section 12 in the collapsed-storage position (as shown in FIG. 6) to minimize a footprint of the ECU 10 for storage and transport. The mobile section 14 extends from the base section 12 in the expanded-use position (as shown in FIGS. 3 and 4) to provide air flow (as suggested in FIG. 7) through an enclosed space, such as a building structure or temporary shelter. Exemplary processes for moving the ECU 10 from the collapsed-storage position to the expanded-use position are illustrated in FIGS. 8-14 and 16-25. The temperature control system 16 is configured to raise or lower a temperature of the air passing through the mobile section 14 to provide heated or cooled air to the enclosed space.

Figure 5:
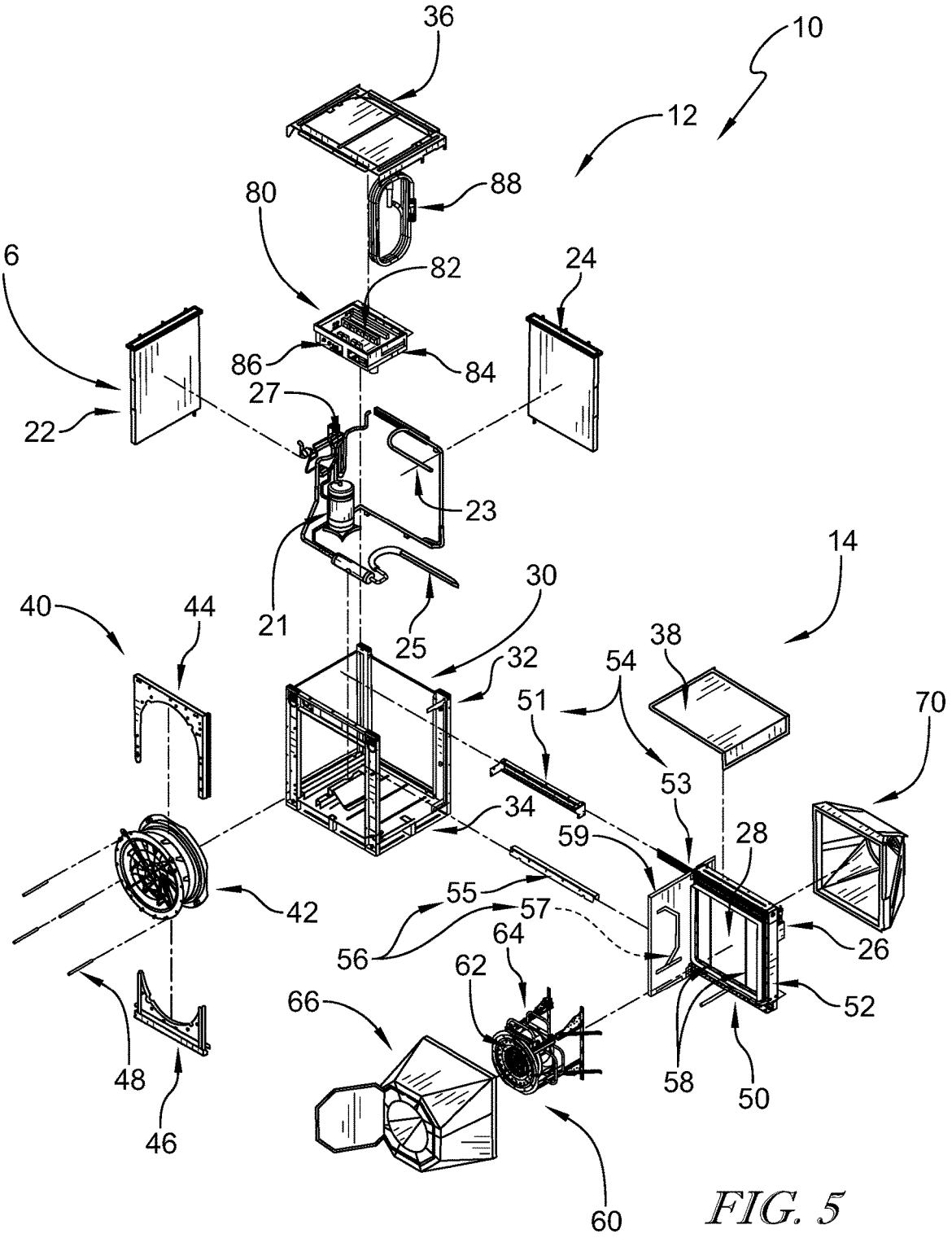
FIG. 5 is a perspective exploded assembly view of the ECU of FIG. 1 showing that the temperature control system includes a compressor and outdoor heat exchangers coupled to the base section and an expansion device and an indoor heat exchanger coupled to the mobile section for movement therewith relative to the base section.

In the illustrative embodiment, the temperature control system 16 includes a compressor 21 and outdoor heat exchangers 22, 24 coupled to the base section 12 and an expansion device 26 and an indoor heat exchanger 28 coupled to the mobile section 14 for movement therewith relative to the base section 12 as shown in FIG. 5. The outdoor heat exchangers 22, 24 are arranged to exchange heat with air outside of the enclosed space, and the indoor heat exchanger 28 is arranged to exchange heat with air flowing through the mobile section 14 to provide heated or cooled air to the enclosed space. The compressor 21 and outdoor heat exchangers 22, 24 are coupled to the expansion device 26 and indoor heat exchanger 28 by lines 23, 25 to form a closed circuit for passage of a working fluid, such as a refrigerant. A reversing valve 27 is configured to selectively control a direction of flow of the working fluid through the temperature control system 16 to allow heating or cooling of the indoor heat exchanger 28 in order to heat or cool the air passing through the mobile section 14. In some embodiments, the reversing valve 27 is omitted such that the ECU 10 operates solely as an air conditioner (for cooling air passing through the mobile section 14) or heat pump (for heating air passing through the mobile section 14). In some embodiments, other arrangements of the temperature control system 16 are contemplated. For example, one of the outdoor heat exchangers 22, 24 could be replaced with a wall or panel, or an additional outdoor heat exchanger could be added. In some embodiments, the temperature control system 16 could be flipped with the expansion device 26 and indoor heat exchanger 28 coupled to the base section 12 and the compressor 21 and one or more of the outdoor heat exchangers 22, 24 coupled to the mobile section 14. In some embodiments, the outdoor heat exchangers 22, 24 could move relative to the indoor heat exchanger 28 from a collapsed-storage position to an expanded-use position.

As shown in FIG. 5, the exemplary base section 12 includes a housing 30 and a fan assembly 40 coupled to the housing 30. The mobile section 14 includes a carriage 50, an air return 60 coupled to the carriage 50, and an air supply 70 coupled to the carriage 50 opposite from the air return 60. The temperature control system 16 is coupled to the housing 30 and carriage 50. The carriage 50 is arranged for movement relative to the housing 30, and the air return 60 and air supply 70 are arranged for movement relative to the carriage 50 to move the ECU 10 between the collapsed-storage and expanded-use positions. The fan assembly 40 is configured to pull air through the outdoor heat exchangers 22, 24 into a plenum 31 of the housing 30 to promote heat transfer between the air and the outdoor heat exchangers 22, 24 as suggested in FIG. 7. The air passes out of the plenum 31 through the fan assembly 40. The air return 60 is configured to pull air from the enclosed space (such as through a return conduit 97) into a plenum 92 of the air return 60, push the air through the indoor heat exchanger 28 into a plenum 94 of the air supply 70 to promote heat transfer between the indoor heat exchanger 28 and the air to heat or cool the air, and force the heated or cooled air out of the air supply 70 and back to the enclosed space (such as through a supply conduit 99). The air flow through the plenum 31 is separate from the air flow through the plenums 92, 94.

Figure 8:
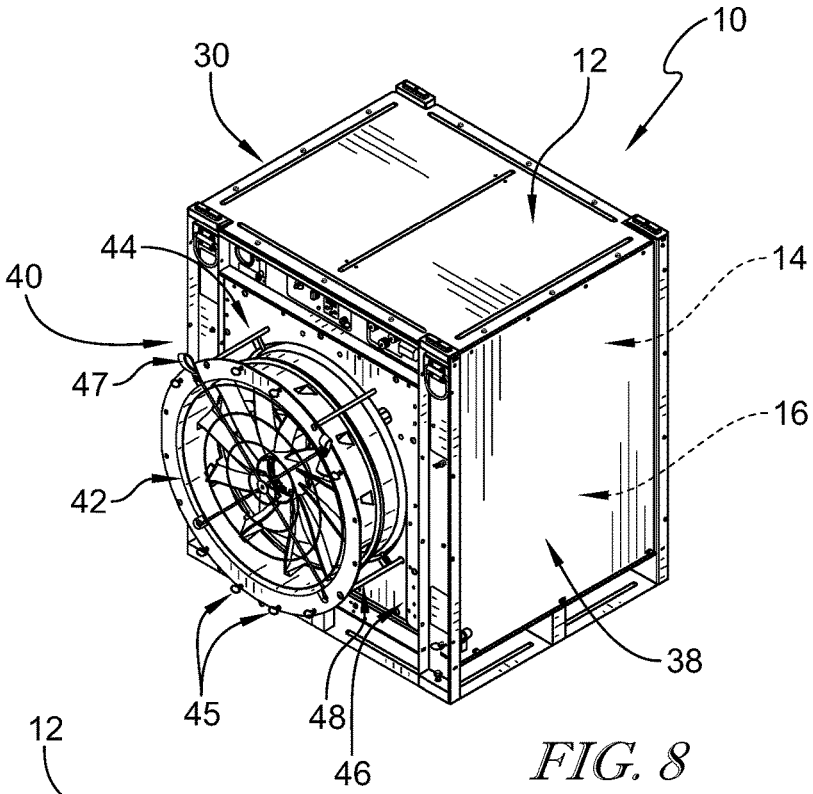
FIGS. 8-14 are a series of views illustrating an exemplary process for moving the ECU from the collapsed-storage position to the expanded-use position.
Figure 9:
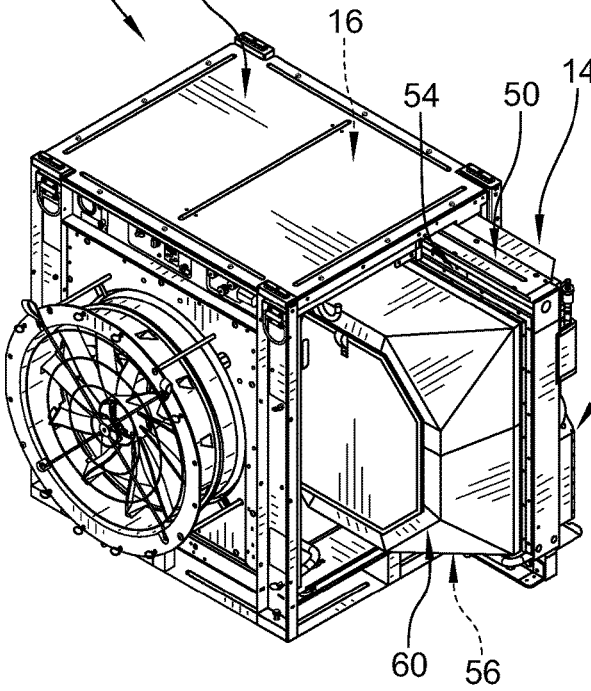
Figure 10:
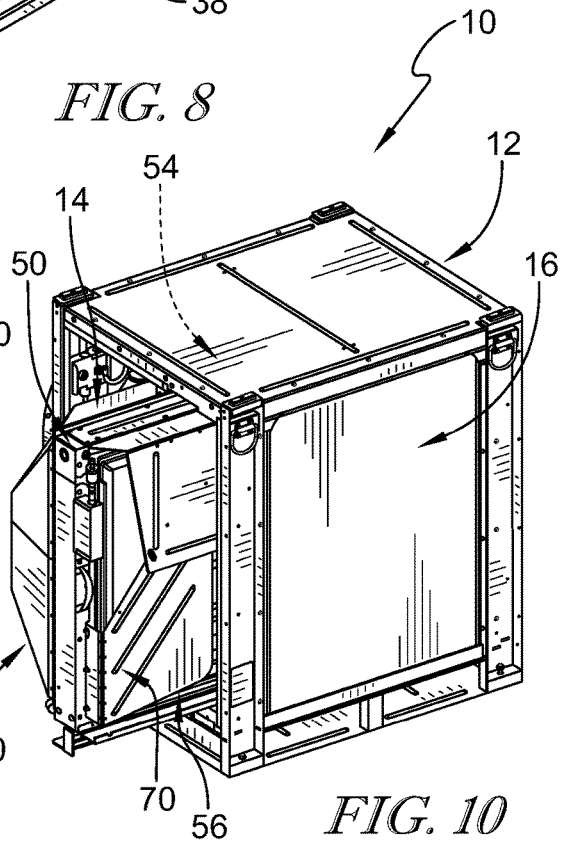
Figure 12:
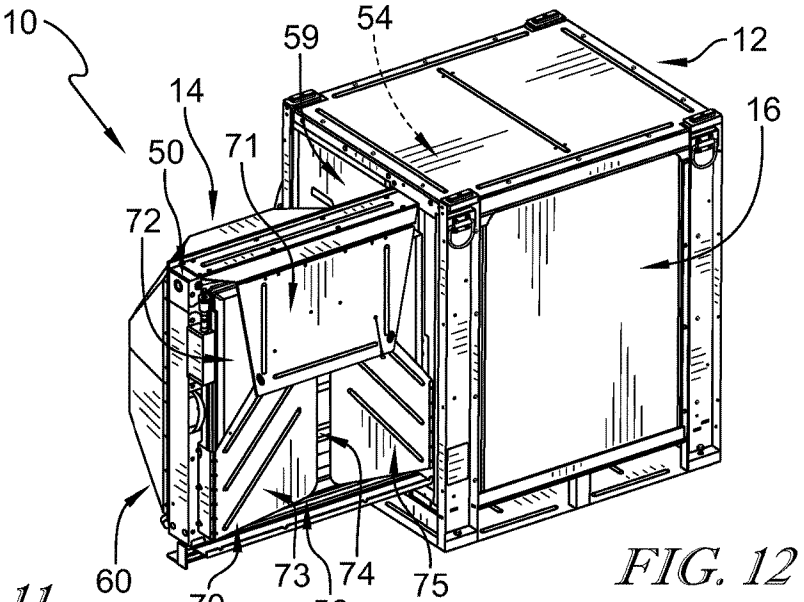
Figure 14:
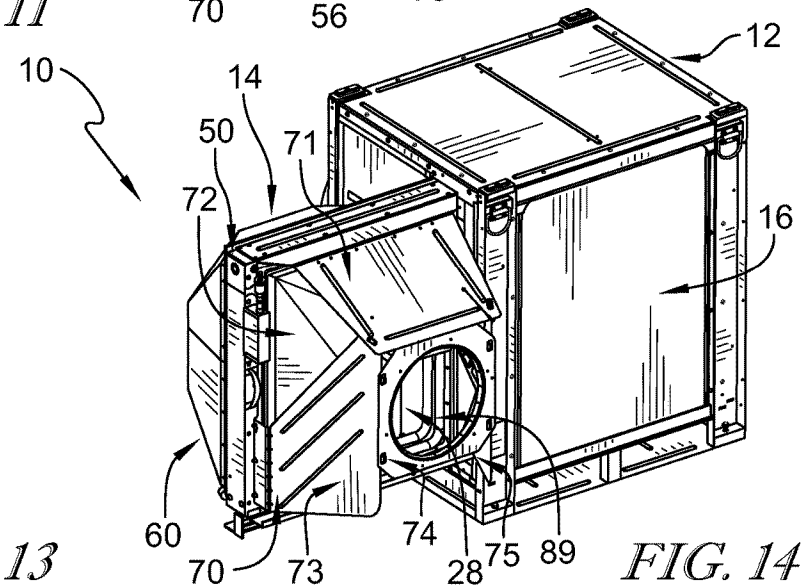
Figure 11:
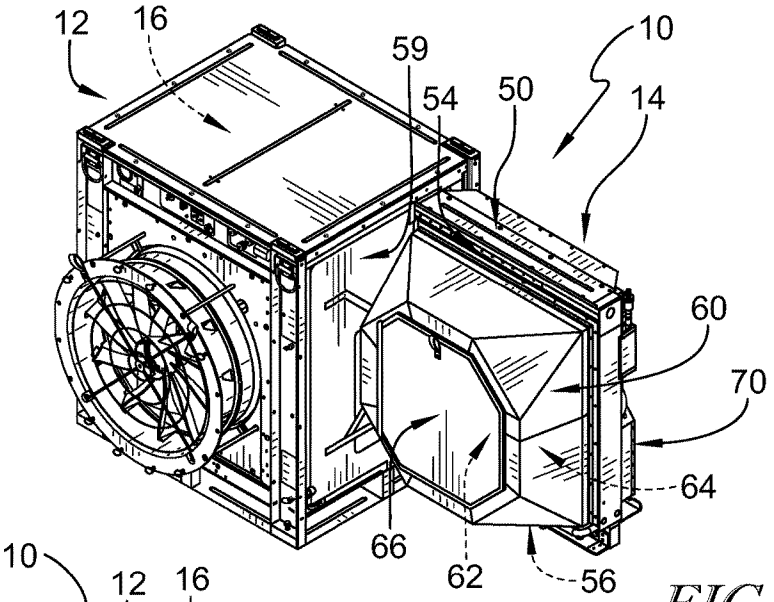
Figure 13:
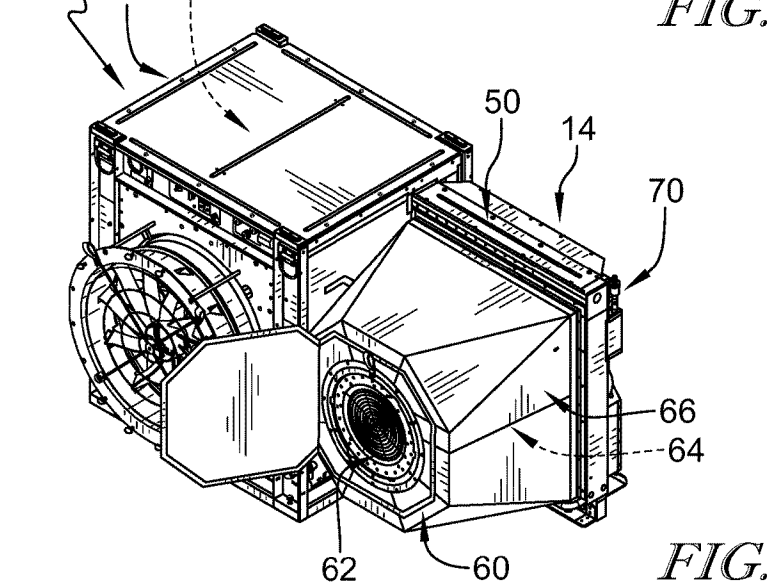

The housing 30 of the base section 12 includes a plurality of posts 32 coupled to a platform 34 and a lid 36 coupled to the posts 32 opposite from the platform 34 as shown in FIG. 5. A flexible panel 38 is coupled to the housing 30 and is configured to move between a closed position covering a side of the housing 30, as shown in FIG. 8, and an opened position extending away from the housing 30, as shown in FIGS. 3 and 4. In the closed position, the panel 38 engages with the housing 30 to block movement of the mobile section 14 from the collapsed-storage position to the expanded-use position. The mobile section 14 can move to the expanded-use positon with the panel 38 in the opened position.

In the illustrative embodiment, the fan assembly 40 includes a fan unit 42, clamp members 44, 46, and rods 48 as shown in FIG. 5. The clamp members 44, 46 extend around the fan unit 42, and the rods 48 are coupled to the fan unit 42 and extend through the clamp members 44, 46 to allow sliding movement of the fan unit 42 relative to the housing 30 between an inboard position substantially arranged within the housing 30, shown in FIGS. 1 and 6, and an outboard position extending away from the housing 30, shown in FIGS. 7 and 8. In some embodiments, linear bearings (not shown) are coupled to the clamp members 44, 46 and support the rods 48 for sliding movement. In some embodiments, one or more plates 41 are coupled to the fan unit 42 and one or more magnets 43 are coupled to the clamp member 44 and/or clamp member 46 as shown in FIG. 6. The plate 41 is formed from a magnetically attractive material, such as metal or another magnet, and the magnet 43 is arranged to bias the plate 41 toward the magnet 43 to hold the fan unit 42 in the outboard position. In some embodiments, the magnet 43 is coupled to the fan unit 42 and the plate 41 is coupled to the clamp member 44 and/or clamp member 46. One or more fasteners 45 (FIG. 8), such as quarter-turn fasteners, are coupled to the fan unit 42 and arranged to selectively engage with the clamp member 44 and/or clamp member 46 to hold the fan unit 42 in the inboard position. In some embodiments, a strap or handle 47 is coupled to the fan unit 42 to allow a user to move the fan unit from the inboard position to the outboard position.

The carriage 50 of the mobile section 14 includes a frame 52 and slide mechanisms 54, 56 coupled to the frame 52 as shown in FIG. 5. The carriage 50 is movable between a stowed position, shown in FIGS. 1 and 6, and a deployed position, shown in FIGS. 7, 11, and 12. The slide mechanisms 54, 56 each include interfacing rail members 51, 53 and 55, 57, respectively, that allow substantially linear movement of the frame 52 relative to the housing 30. The rail members 51, 55 are coupled to the housing 30 and the rail members 53, 57 are coupled to the frame 52. In some embodiments, other mechanisms are used in place of the slide mechanisms 54, 56, such as hinges. In some embodiments, the slide mechanisms 54, 56 are omitted and a user can freely move the mobile section 14 relative to the base section 12 and mount the mobile section 14 on the housing 30 or a separate stand.

Figure 15:
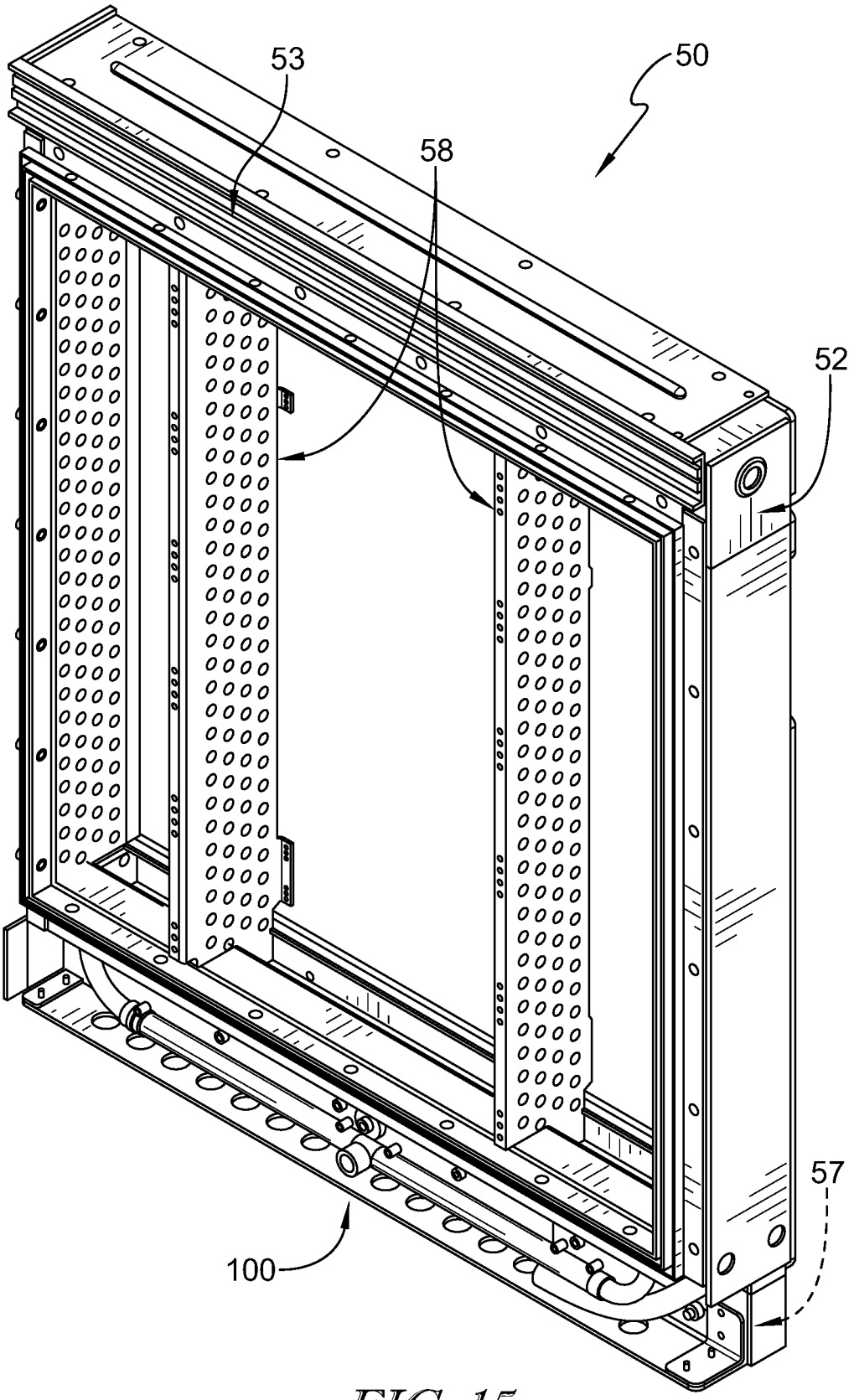
FIG. 15 is a perspective view of a carriage of the mobile section.

In the illustrative embodiment, the expansion device 26 and indoor heat exchanger 28 of the temperature control system 16 are coupled to the frame 52 for movement therewith relative to the base section 12, and the lines 23, 25 are flexible to accommodate the movement of the expansion device 26 and indoor heat exchanger 28 relative to other components of the temperature control system 16 coupled to the base section 12. In some embodiments, braces 58 are coupled to the frame 52 substantially aligned with the indoor heat exchanger 28 to provide mounting points for other components of the mobile section 14, such as the air return 60, as shown in FIGS. 5 and 15. A panel 59 is coupled to the frame 52 and arranged to cover a side of the housing 30 and form part of the plenum 31 with the ECU 10 in the expanded-use position. In some embodiments, the panel 59 is flexible and held in place relative to the housing 30 using complementary magnetic strips or strips of hook and loop material along the perimeter of the panel 59.

Figure 7:
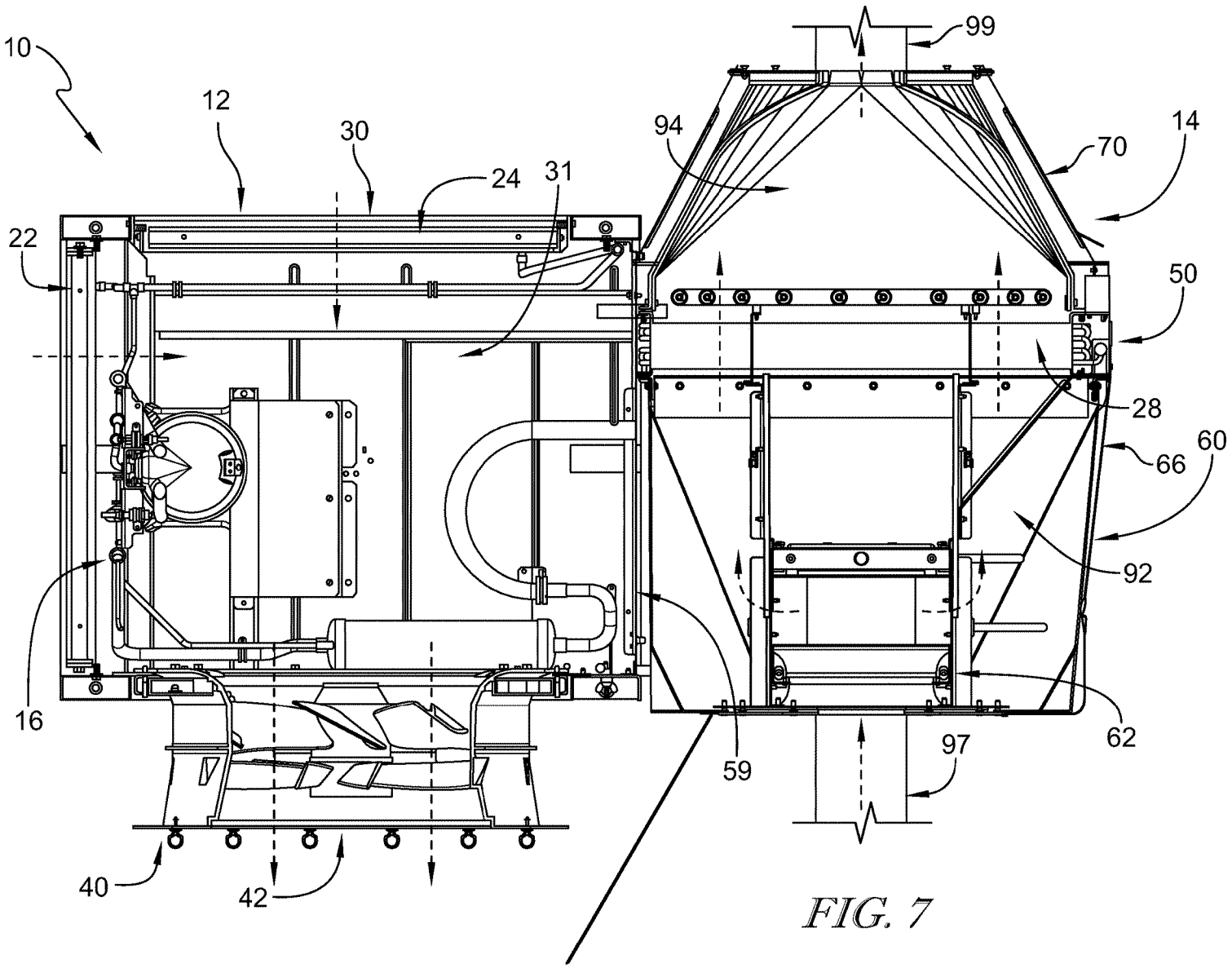
FIG. 7 is a section view taken along line 7-7 in FIG. 3 showing the mobile section extending from the base section in the expanded-use position and suggesting that air flows into an air return of the mobile section, passes through the indoor heat exchanger of the temperature control system, and flows out of an air supply of the mobile section.

In the illustrative embodiment, the air return 60 includes a blower unit 62 coupled to an extendable strut 64, and a flexible shroud 66 coupled to the blower unit 62 and to the frame 52 of the carriage 50 to define the plenum 92 as shown in FIGS. 5 and 7. The strut 64 allows selective movement of the blower unit 62 between a retracted position, shown in FIG. 16, and an extended position, shown in FIG. 17, relative to the carriage 50. The flexible shroud 66 moves with the blower unit 62 as suggested in FIGS. 11 and 13.

Figure 16:
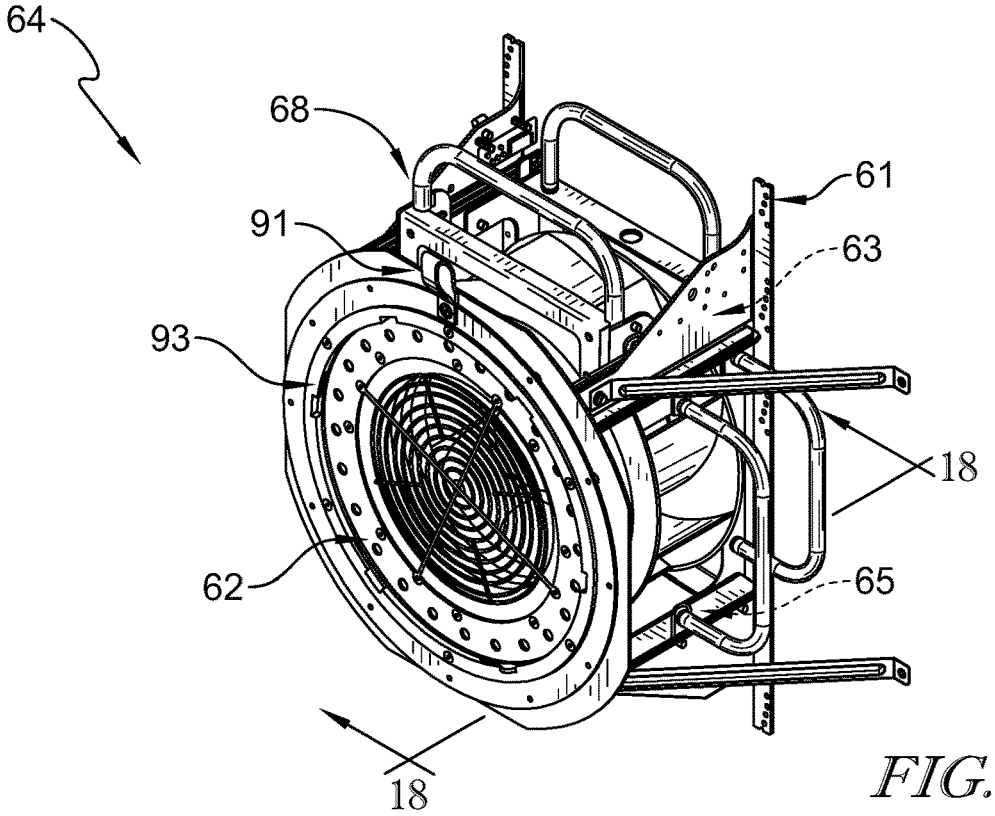
FIG. 16 is a perspective view of an extendable strut of the air return of the mobile section showing a blower unit coupled to the strut for movement relative to the carriage between a stowed position, shown in FIG. 16, and deployed position, shown in FIG. 17.
Figure 17:
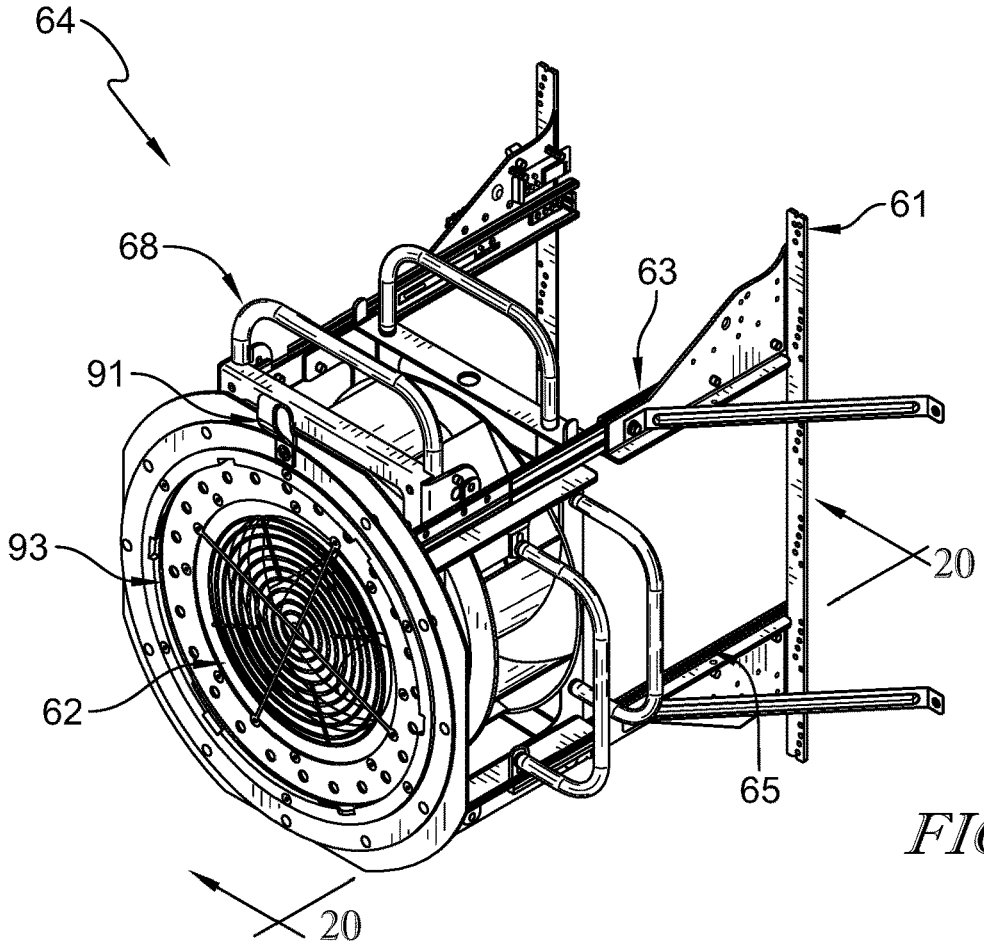
FIG. 17 is a view similar to FIG. 16 showing the strut in the extended position.
Figure 18:
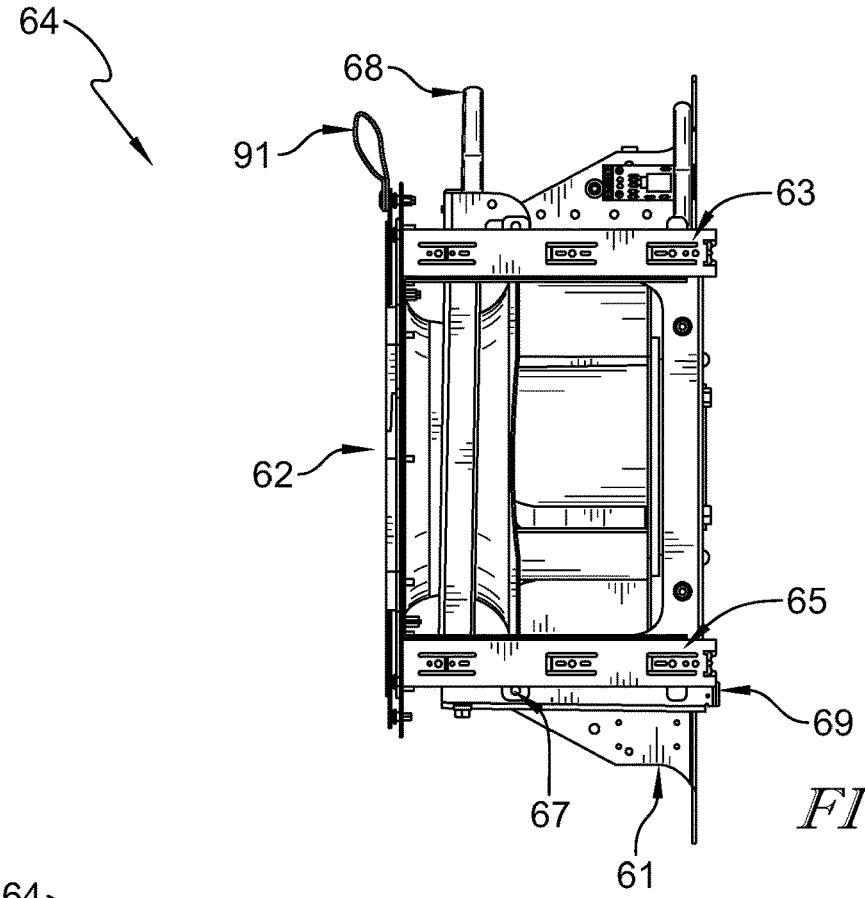
FIGS. 18-21 are a series of views illustrating an exemplary process for moving the strut from the retracted position to the extended position.
Figure 19:
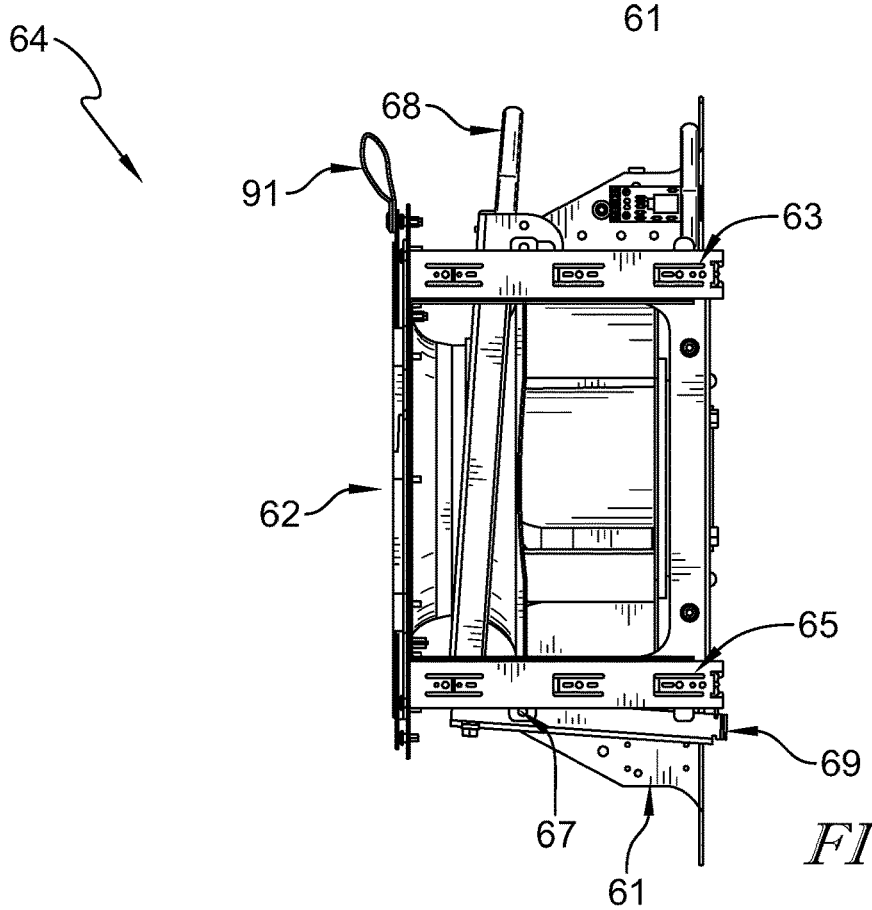
Figure 20:
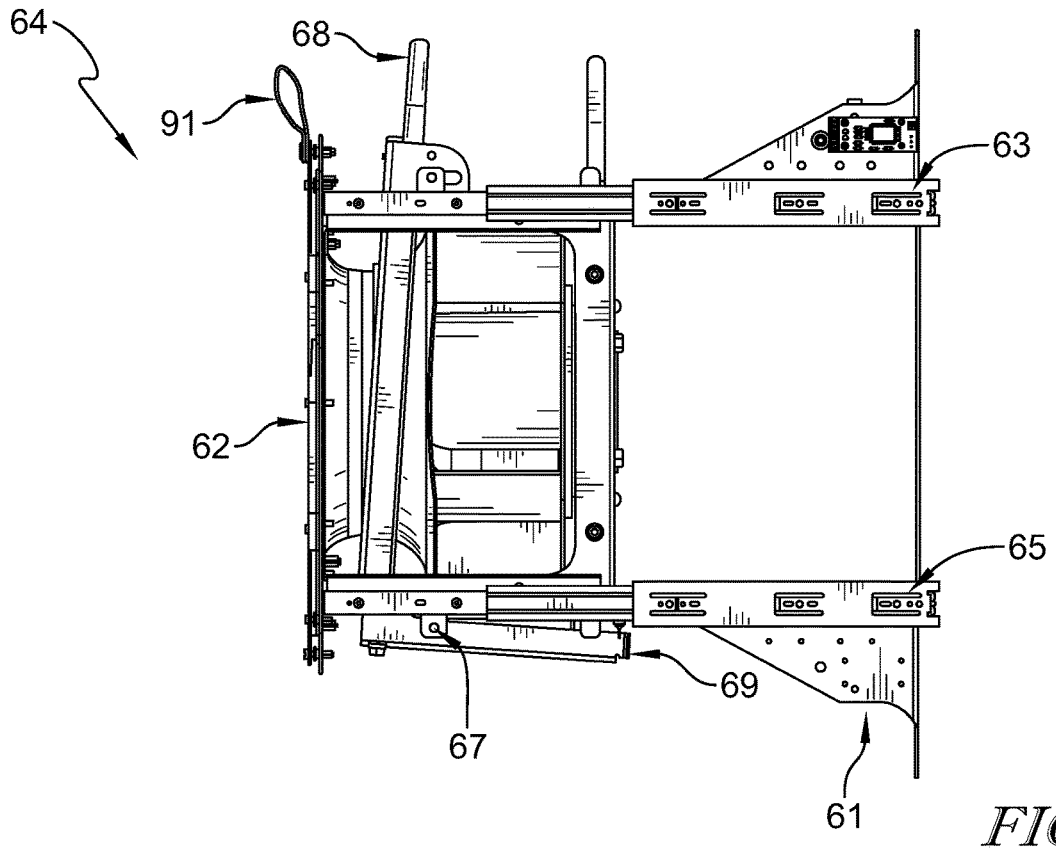

The extendable strut 64 includes a pair of spaced apart brackets 61 and corresponding pairs of slide mechanisms 63, 65 coupled to the brackets 61 as shown in FIGS. 16 and 17. The blower unit 62 is coupled to the slide mechanisms 63, 65 for movement relative to the brackets 61. In some embodiments, the slide mechanisms 63, 65 are arranged similar to the slide mechanisms 54, 56 and have interfacing rail members that allow substantially linear movement of the blower unit 62 relative to the brackets 61. The brackets 61 are coupled to the braces 58 of the carriage 50.

Figure 21:
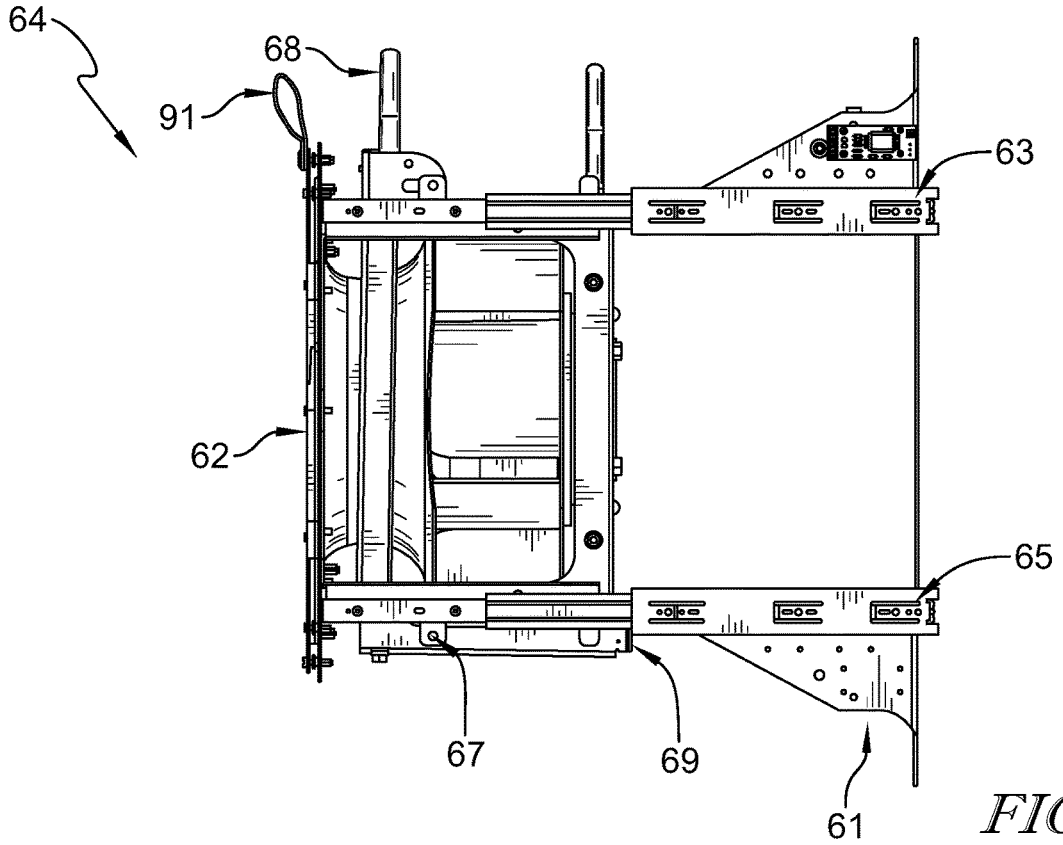
Figure 22:
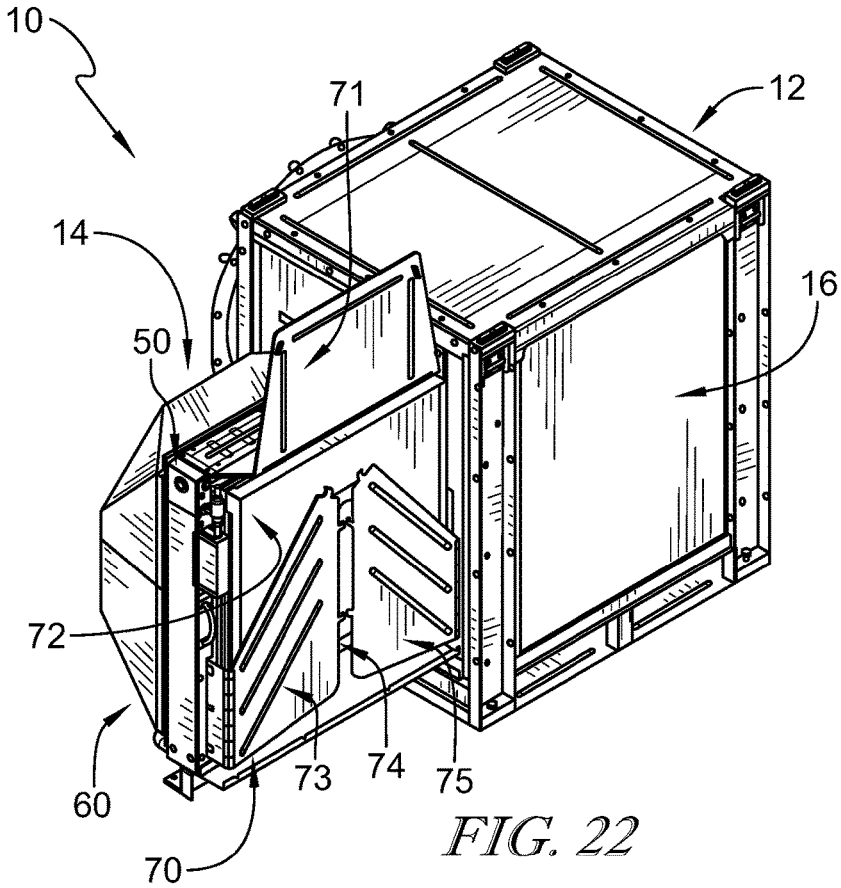
FIGS. 22-25 are a series of views illustrating an exemplary process for moving the air supply of the mobile section from a flattened position, shown in FIGS. 12 and 22, to an erected position, shown in FIGS. 14 and 24.
Figure 23:
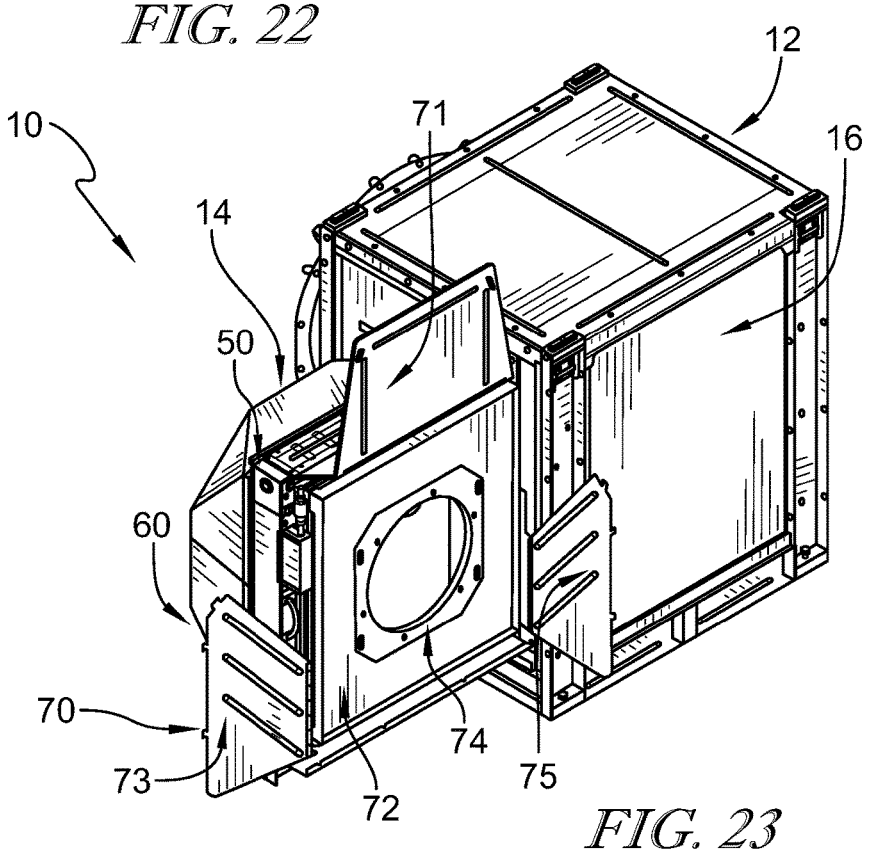
Figure 24:
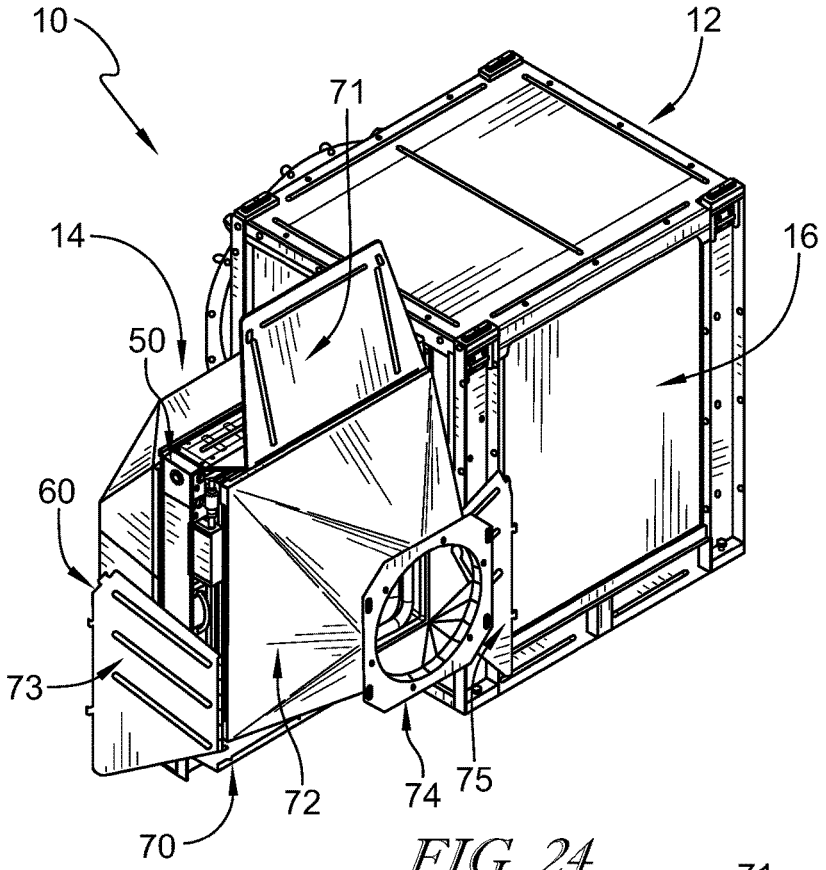
Figure 25:
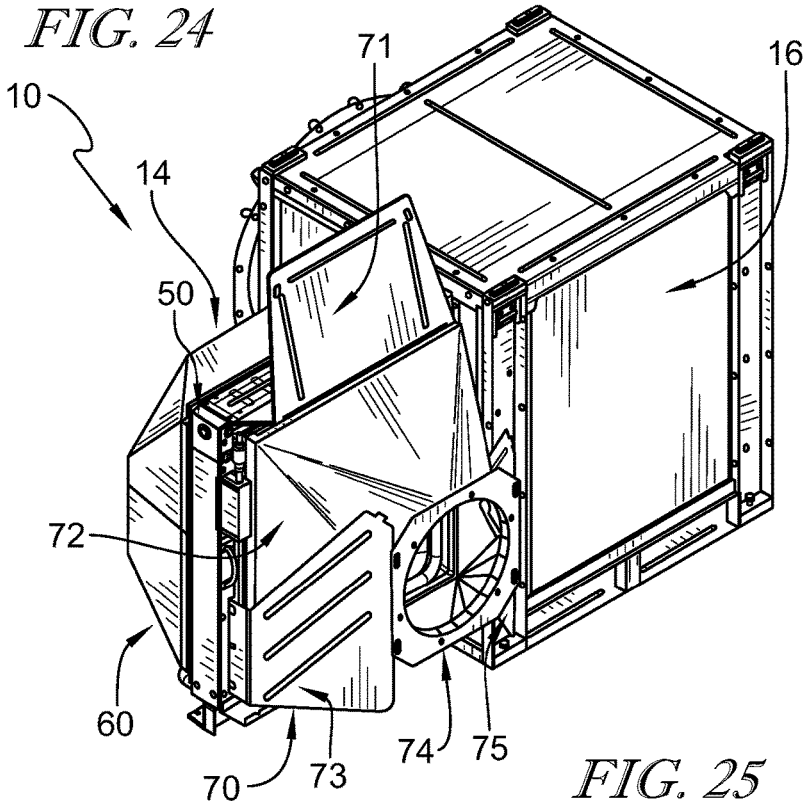
Figure 26:
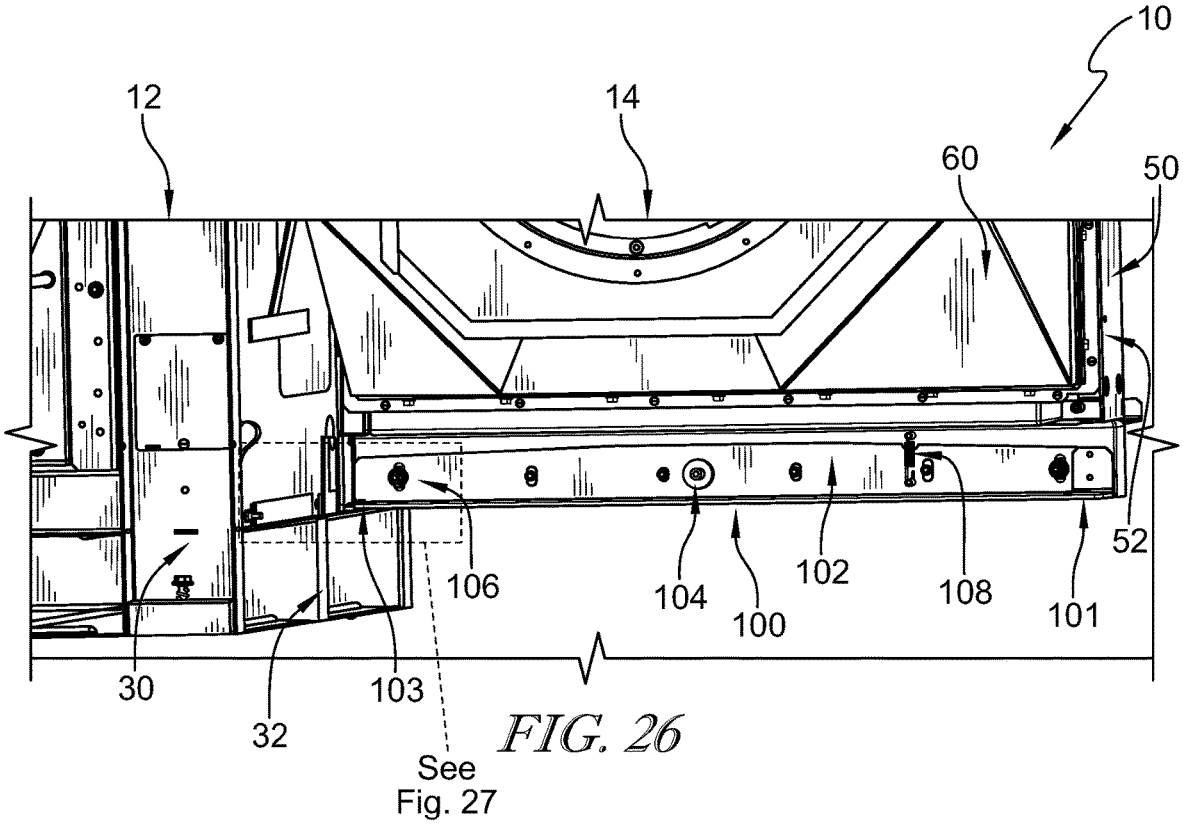
FIG. 26 is an enlarged view of the ECU of FIG. 1 showing a brace coupled to the mobile section and suggesting that an arm of the brace is movable between an unlocked position, shown in FIGS. 26 and 27, and a locked position, shown in FIGS. 28 and 29.
Figure 27:
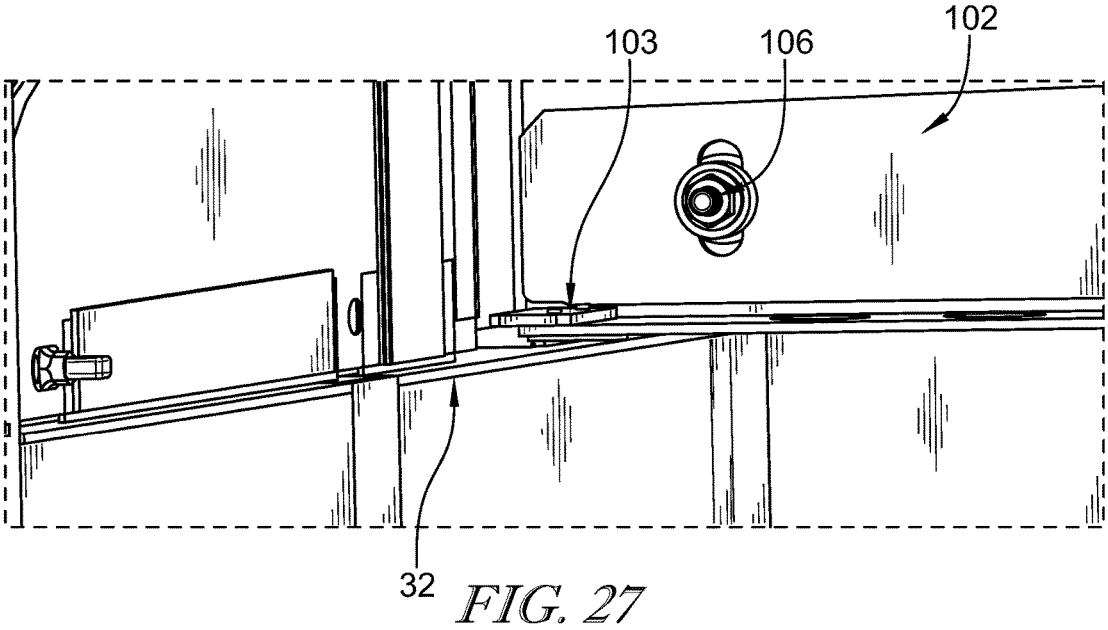
FIG. 27 is an enlarged view of the brace of FIG. 26 showing the arm in the unlocked position with a proximal end of the arm spaced apart from a platform of the base section to allow movement of the mobile section from the expanded-use position toward the collapsed-storage position.
Figure 28:
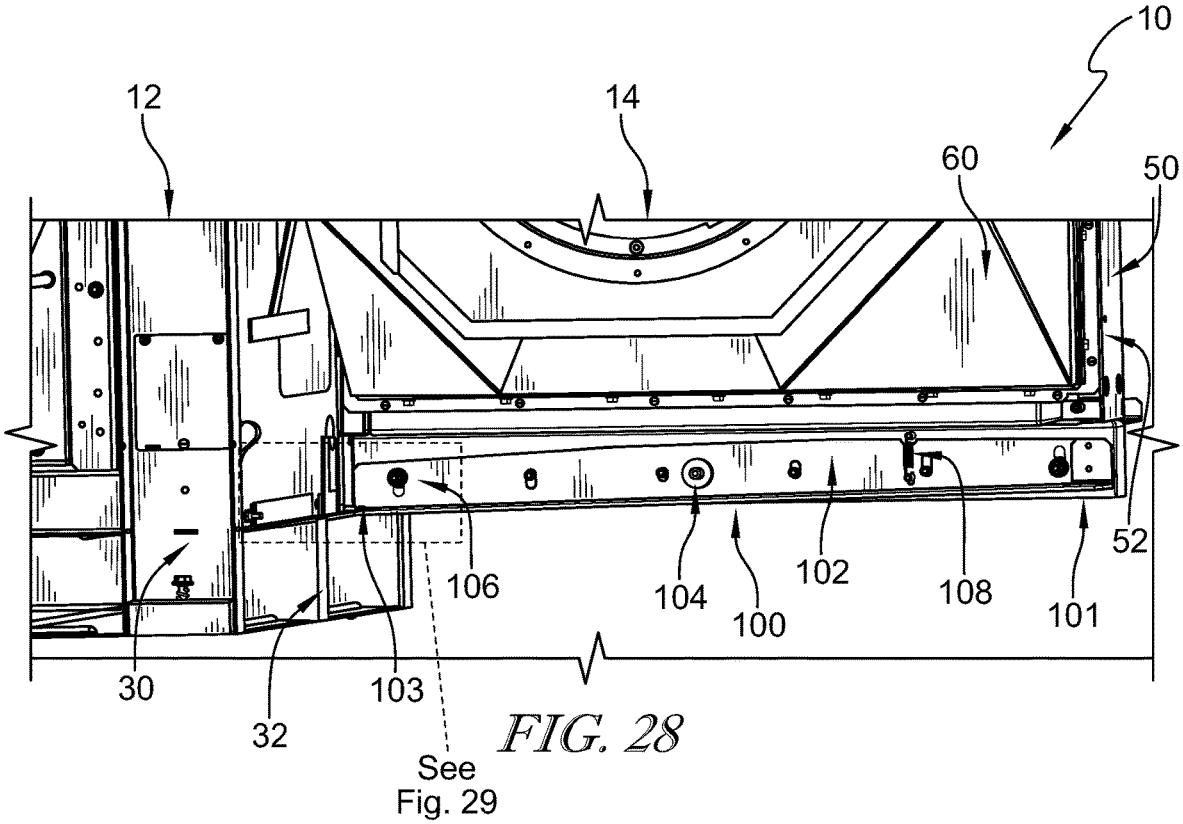
FIG. 28 is a view similar to FIG. 26 showing the arm in the locked position.
Figure 29:
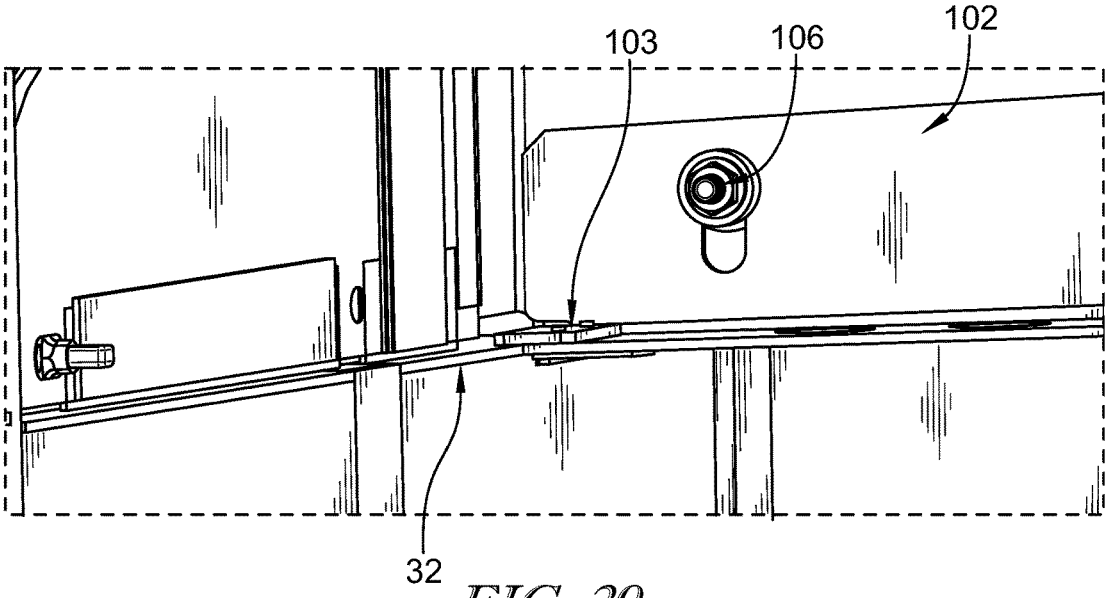
FIG. 29 is an enlarged view of the brace of FIG. 28 showing that the proximal end of the arm engages with the platform of the base section to block movement of the mobile section from the expanded-use position toward the collapsed-storage position.

As shown in FIGS. 18-21, a latch 68 of the strut 64 controls movement of the blower unit 62 between the extended and retracted positions. The latch 68 is mounted for rotation about a pivot 67, such as a fastener, between a stay position, shown in FIGS. 18 and 20, and a release position, shown in FIGS. 19 and 21. Tabs 69 extend laterally from the latch 68 to engage with the slide mechanism 65 to block movement of the blower unit 62 with the latch 68 in the stay position. A user can move the latch 68 to the release positon and grab a strap or handle 91 coupled to the blower unit 62 to move the blower unit 62 to the extended position as suggested in FIGS. 18-20. The latch 68 is moved to the stay position to block movement of the blower unit 62 from the extended position toward the retracted position as shown in FIG. 21. In some embodiments, a biasing element (not shown), such as a spring, can bias the latch 68 toward the stay position. In some embodiments, a coupling 93 is formed on the blower unit 62 for attachment of a return conduit 97. Various forms of attachment are possible, and the present disclosure is not limited to the coupling 93 shown.

In the illustrative embodiment, the air supply 70 includes a flexible shroud 72 coupled to the carriage 50, a hanger 74 coupled to the shroud 72, and a plurality of flaps 71, 73, 75 pivotally coupled to the carriage 50. The air supply 70 is movable between a flattened position, shown in FIGS. 12 and 22, to an erected position, shown in FIGS. 14 and 24. The flaps 71, 73, 75 are substantially rigid to provided support for the hanger 74 in the erected position. The shroud 72, hanger 74, and flaps 71, 73, 75 extend along the carriage 50 in the flattened position and extend away from the carriage 50 in the erected position. An exemplary process for moving the air supply 70 from the flattened position to the erected position is illustrated in FIGS. 22-25. With the mobile section 14 in the expanded-use position, the flaps 71, 73, 75 are pivoted away from the shroud 72 as suggested in FIGS. 22 and 23. The hanger 74 is moved away from the carriage 50 to extend the shroud 72 and define the plenum 94 as suggested in FIGS. 23 and 24. The flaps 73, 75 are pivoted toward the shroud 72 and the hanger 74 is mounted on the flaps 73, 75 as suggested in FIGS. 24 and 25. The flap 71 is pivoted toward the flaps 73, 75 as suggested in FIG. 4. In some embodiments, the flap 71 engages with the flaps 73, 75 and secured with one or more fasteners to block the hanger 74 from being removed from the flaps 73, 75 and to block the flaps 73, 75 from pivoting away from the hanger 74. In some embodiments, a coupling is formed on the hanger 74 for attachment of a supply conduit 99. Various forms of attachment are possible, and the present disclosure is not limited to any particular coupling.

Figure 30:
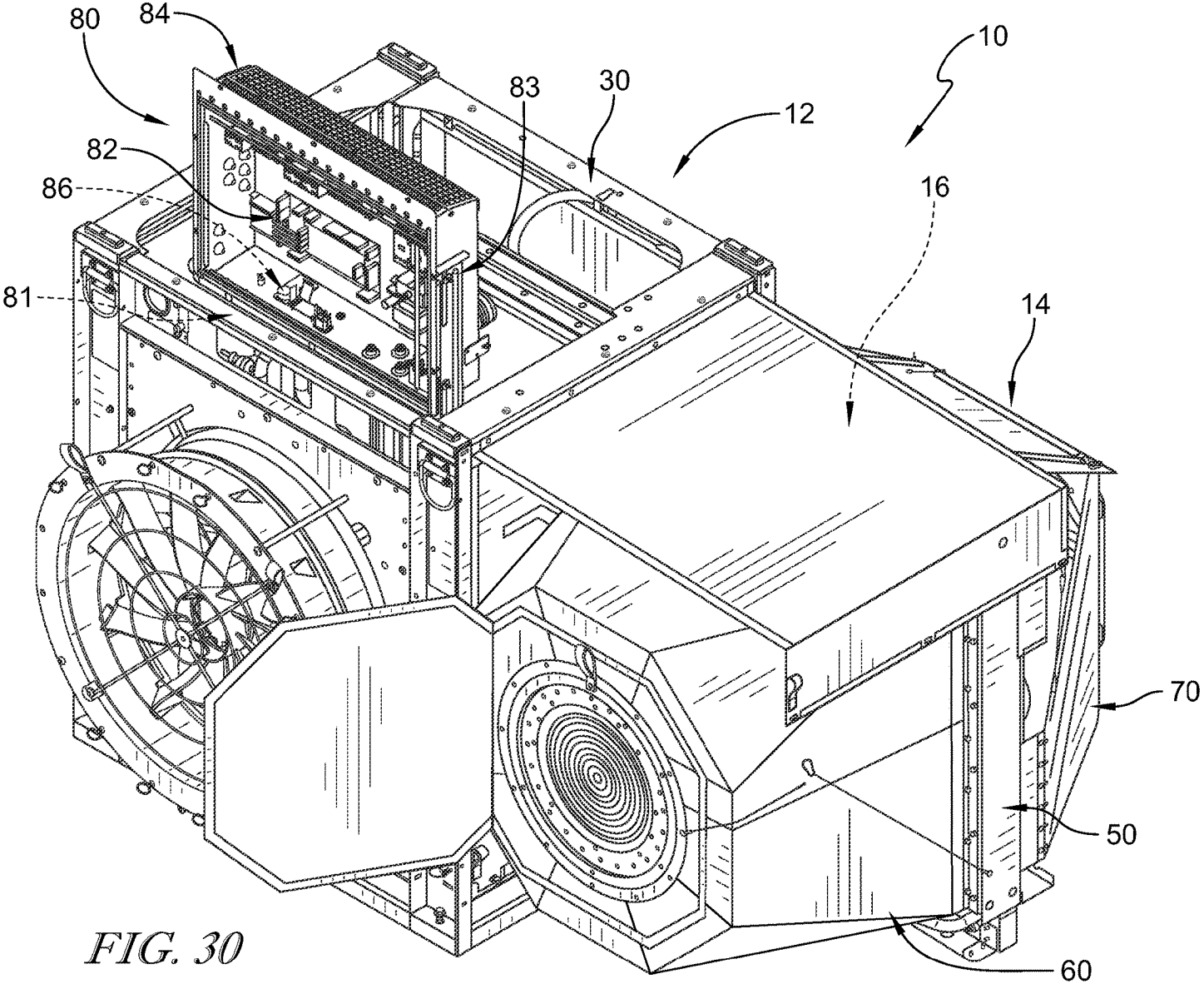
FIG. 30 is a view similar to FIG. 3 showing a control module of the ECU pivoted to a raised position relative to the base section.

As shown in FIG. 5, a control module 80 is coupled to the base section 12. The exemplary control module 80 includes a controller 82 mounted in a case 84. The controller 82 is configured to control operation of the ECU 10. A user interface 86 is arranged on the case 84 and is accessible through the housing 30 of the base section 12 to allow a user to operate the ECU 10. A power cable 88 can be stored within the base section 12 during transport and removed to connect the control module 80 with a power source, such as a generator. In some embodiments, the case 84 is pivotally coupled to the housing 30 by a hinge 81 to allow the control module 80 to be moved to a raised position as shown in FIG. 30, such as for service or maintenance. In some embodiments, a latch 83 coupled to the case 84 is configured to slide relative to the case 84 and engage with the housing 30 to hold the control module 80 in the raised position. In some embodiments, a heater 89 is coupled to the carriage 50.

In the illustrative embodiment, a brace 100 is coupled to the mobile section 14 as shown in FIGS. 26-29. The exemplary brace 100 includes an arm 102 coupled to the carriage 50 by a pivot 104, such as a fastener, for rotation about the pivot 104 relative to the carriage 50. The arm 102 defines a distal end 101 extending away from the base section 12 and a proximal end 103 arranged toward the base section 12. One or more pins 106 are coupled to the carriage 50 and extend through the arm 102. The pins 106 engage with the arm 102 to limit pivoting and lateral movement of the arm 102. The arm 102 is movable between an unlocked position, shown in FIGS. 26 and 27, and a locked position, shown in FIGS. 28 and 29. In the unlocked position, the proximal end 103 of the arm 102 is spaced apart from the platform 34 of the housing 30 to allow movement of the mobile section 14 from the expanded-use position toward the collapsed-storage position. In the locked position, the proximal end 103 of the arm 102 engages with the platform 34 to block movement of the mobile section 14 from the expanded-use position toward the collapsed-storage position. The brace 100 also limits bending loads placed on the slide mechanisms 54, 56. The arm 102 engages with the platform 34 in the locked position and the pins 106 engage with the arm 102 and the carriage 50 to distribute at least a portion of the load on the slide mechanisms 54, 56 from the mass of the mobile section 14 through the arm 102 to the platform 34. A biasing member, such as a spring, is coupled to the carriage 50 and the arm 102 to bias the arm 102 toward the locked position. A user can engage with the distal end 101 of the arm 102, such as by stepping on the distal end 101, to move the arm 102 to the unlocked position and allow movement of the mobile section 14 from the expanded-use position toward the collapsed-storage position.

An exemplary process for moving the ECU 10 from the collapsed-storage position to the expanded-use position is illustrated in FIGS. 1-4 and 7-14. The fan unit 42 of the fan assembly 40 is moved from the inboard position, shown in FIG. 1, to the outboard position, shown in FIG. 7. The carriage 50 of the mobile section 14 is moved from the stowed position to the deployed position, as suggested in FIGS. 7-12, to define the plenum 31 of the housing 30. The air return 60 is moved from the retracted position to the extended position to define the plenum 92, as suggested in FIG. 13, and the air supply 70 is moved from the flattened position to the erected position to define the plenum 94, as suggested in FIG. 14.

The exemplary expandable ECU 10 allows for large outdoor heat exchangers and indoor heat exchangers to be used, thereby maximizing efficiency and capacity of the temperature control system 16 and minimizing energy and fuel consumption. The ECU 10 also minimizes the footprint required for transport and storage. The ECU 10 provides separate large plenums for airflow through the outdoor heat exchangers and indoor heat exchangers, further maximizing capacity and efficiency of the temperature control system 16. The arrangement of the base section 12 and mobile section 14 allow for easy access to and replacement of components. Use of various materials for the components in the ECU 10 are contemplated by the present disclosure, such as metals, plastics, fabrics, sheets, and films.

While the present disclosure describes various exemplary embodiments, the disclosure is not so limited. To the contrary, the disclosure is intended to cover various modifications, uses, adaptations, and equivalent arrangements based on the principles disclosed. Further, this application is intended to cover such departures from the present disclosure as come within at least the known or customary practice within the art to which it pertains. It is envisioned that those skilled in the art may devise various modifications and equivalent structures and functions without departing from the spirit and scope of the disclosure as recited in the following claims. The scope of the following claims is to be accorded the broadest interpretation to encompass all such modifications and equivalent structures and functions.

What is claimed is:

1. An environmental control unit comprising:

a base section;

a mobile section coupled to the base section for movement between a collapsed-storage position arranged substantially within the base section and an expanded-use position extending from the base section; and a temperature control system coupled to the base section and the mobile section, the temperature control system configured to selectively heat or cool air flowing through the mobile section, wherein an indoor heat exchanger of the temperature control system is coupled to the mobile section and an outdoor heat exchanger of the temperature control system is coupled to the base section, wherein the indoor heat exchanger is arranged for movement with the mobile section relative to the outdoor heat exchanger between the collapsed-storage and expanded-use positions, and wherein the indoor heat exchanger is arranged substantially within the base section in the collapsed-storage position, and wherein the air return includes a blower unit coupled to an extendable strut and a flexible shroud coupled to the blower unit and to the carriage, wherein the extendable strut is coupled to the carriage and configured to guide movement of the blower unit relative to the carriage for movement of the air return between the retracted and extended positions, and wherein the blower unit is configured to drive air flow through the indoor heat exchanger to promote heat transfer between the indoor heat exchanger and the air.

2. The environmental control unit of claim 1, wherein the mobile section includes a carriage coupled to the base section for movement between a stowed position corresponding to the collapsed-storage position and a deployed position corresponding to the expanded-use position, an air return coupled to the carriage for movement with the carriage relative to the base section, and an air supply coupled to the carriage opposite of the air return for movement with the carriage relative to the base section, wherein the air return is movable between a retracted position and an extended position relative to the carriage, and wherein the air supply is movable between a flattened position and an erected position relative to the carriage.

3. The environmental control unit of claim 2, wherein the carriage includes a frame and a slide mechanism coupled to the frame and to the base section to guide movement of the carriage between the stowed and deployed positions.

4. The environmental control unit of claim 1, wherein the extendable strut includes a bracket and a slide mechanism coupled to the bracket, wherein the blower unit is coupled to the slide mechanism of the extendable strut, and wherein the bracket is coupled to the carriage.

5. The environmental control unit of claim 4, further comprising a latch coupled to the extendable strut, wherein the latch is movable between a stay position and a release position relative to the extendable strut, wherein in the stay position the latch is configured to engage with the slide mechanism to block movement of the air return between the extended and retracted positions, and wherein in the release position the latch is configured to allow movement of the air return between the extended and retracted positions.

6. The environmental control unit of claim 2, wherein the air supply includes a flexible shroud coupled to the carriage, a hanger coupled to the shroud, and a flap pivotally coupled to the carriage, and wherein the shroud, hanger, and flap extend along the carriage in the flattened position and extend away from the carriage in the erected position.

7. The environmental control unit of claim 6, wherein the hanger is mounted on the flap in the erected position.

8. The environmental control unit of claim 1, further comprising a fan assembly coupled to the base section, wherein the fan assembly is configured to pull air through the outdoor heat exchanger to promote heat transfer between the air and the outdoor heat exchanger.

9. The environmental control unit of claim 8, wherein the fan assembly includes a fan unit, clamp members, and rods, wherein the clamp members extend around the fan unit, wherein the rods are coupled to the fan unit and extend through the clamp members to allow sliding movement of the fan unit relative to the base section between an inboard position arranged substantially within the base section and an outboard position extending away from the base section.

10. An environmental control unit comprising:

a base section;

a mobile section coupled to the base section for movement between a collapsed-storage position arranged substantially within the base section and an expanded-use position extending from the base section, the mobile section including a carriage coupled to the base section for movement between a stowed position corresponding to the collapsed-storage position and a deployed position corresponding to the expanded-use position, an air return coupled to the carriage for movement with the carriage relative to the base section, and an air supply coupled to the carriage opposite of the air return for movement with the carriage relative to the base section; and a temperature control system coupled to the base section and the mobile section, the temperature control system configured to selectively heat or cool air flowing through the mobile section, wherein movement of the carriage from the stowed position to the deployed position defines a first plenum within the base section to allow air flow through an outdoor heat exchanger coupled to the base section, wherein movement of the air return from a retracted position to an extended position relative to the carriage defines a second plenum and movement of the air supply from a flattened position to an erected position relative to the carriage defines a third plenum to allow air flow through an indoor heat exchanger coupled to the mobile section, and wherein the air return includes a blower unit coupled to an extendable strut and a flexible shroud coupled to the blower unit and to the carriage, wherein the extendable strut is coupled to the carriage and configured to guide movement of the blower unit relative to the carriage for movement of the air return between the retracted and extended positions, and wherein the blower unit is configured to drive air flow through the second and third plenums.

11. The environmental control unit of claim 10, wherein the carriage includes a frame and a slide mechanism coupled to the frame and to the base section to guide movement of the carriage between the stowed and deployed positions.

12. The environmental control unit of claim 10, wherein the extendable strut includes a bracket and a slide mechanism coupled to the bracket, wherein the blower unit is coupled to the slide mechanism of the extendable strut, and wherein the bracket is coupled to the carriage.

13. The environmental control unit of claim 10, wherein the air supply includes a flexible shroud coupled to the carriage, a hanger coupled to the shroud, and a flap pivotally coupled to the carriage, and wherein the shroud, hanger, and flap extend along the carriage in the flattened position and extend away from the carriage in the erected position, and wherein the hanger is mounted on the flap in the erected position.

14. The environmental control unit of claim 10, further comprising a fan assembly coupled to the base section, wherein the fan assembly is configured to pull air through the first plenum.

15. The environmental control unit of claim 14, wherein the fan assembly includes a fan unit, clamp members, and rods, wherein the clamp members extend around the fan unit, wherein the rods are coupled to the fan unit and extend through the clamp members to allow sliding movement of the fan unit relative to the base section between an inboard position arranged substantially within the base section and an outboard position extending away from the base section.

* * * * *